US008132812B2

(12) United States Patent
Tsusaka et al.

(10) Patent No.: US 8,132,812 B2
(45) Date of Patent: Mar. 13, 2012

(54) SHEET DISCHARGING DEVICE AND IMAGE FORMING APPARATUS

(75) Inventors: Shusaku Tsusaka, Nagoya (JP); Yoshikatsu Kameyama, Gifu-ken (JP); Junki Ueyama, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 304 days.

(21) Appl. No.: 11/442,963

(22) Filed: May 31, 2006

(65) Prior Publication Data

US 2007/0000966 A1 Jan. 4, 2007

(30) Foreign Application Priority Data

May 31, 2005 (JP) ..... 2005-159431

(51) Int. Cl.
*B65H 5/02* (2006.01)

(52) U.S. Cl. ..... 271/274; 271/314

(58) Field of Classification Search ..... 271/272, 271/273, 274, 314, 188, 209, 207
See application file for complete search history.

(56) References Cited

U.S. PATENT DOCUMENTS

| | | | | |
|---|---|---|---|---|
| 5,661,573 | A * | 8/1997 | Takehara et al. | 358/498 |
| 5,980,141 | A * | 11/1999 | Donnis | 400/625 |
| 7,080,836 | B2 * | 7/2006 | Hamada et al. | 271/274 |
| 2004/0262837 | A1 * | 12/2004 | Hamada et al. | 271/272 |

FOREIGN PATENT DOCUMENTS

| | | | |
|---|---|---|---|
| JP | 63-004945 | | 1/1988 |
| JP | 1-028159 | | 1/1989 |
| JP | 64-28159 | * | 1/1989 |
| JP | 2-132033 | * | 5/1990 |
| JP | 2-103051 | | 8/1990 |
| JP | 4-64568 | * | 2/1992 |
| JP | 06-011918 | | 1/1994 |
| JP | 6-255868 | | 9/1994 |
| JP | 11-003015 | | 1/1999 |
| JP | 2001-206562 | | 7/2001 |
| JP | 2001-310857 | | 11/2001 |
| JP | 2003-145866 | | 5/2003 |
| JP | 2003-326778 | * | 11/2003 |
| JP | 2004-035175 | | 2/2004 |

(Continued)

OTHER PUBLICATIONS

Japanese Office Action, with English Translation issued in Japanese Patent Application No. JP 2005-159431, mailed on Jan. 22, 2008.

(Continued)

*Primary Examiner* — Gerald Mcclain
*Assistant Examiner* — Thomas Morrison
(74) *Attorney, Agent, or Firm* — McDermott Will & Emery LLP

(57) ABSTRACT

A sheet discharging device that includes: a discharge roller that discharges a transported sheet to outside the sheet discharging device, the discharge roller being integrally formed with a flexible rotating shaft; first and second bearing members that rotatably hold one end side and another end side of the rotating shaft, respectively; a nipping member that nips the transported sheet in cooperation with the discharge roller, the nipping member being opposed to a peripheral surface of the discharge roller; and an abutment member abutting against one of the rotating shaft and the nipping member between the first bearing member and the second bearing member to curve the rotating shaft.

19 Claims, 12 Drawing Sheets

FOREIGN PATENT DOCUMENTS

| | | |
|---|---|---|
| JP | 2004-109886 | 4/2004 |
| JP | 2004-205594 | 7/2004 |
| JP | 2005-001827 | 1/2005 |
| JP | 2005-035731 | 2/2005 |

OTHER PUBLICATIONS

Japanese Office Action, with English Translation, issued in Japanese Patent Application No. JP 2004-285191, mailed on Jan. 22, 2008.

* cited by examiner

SHEET DISCHARGING DEVICE AND IMAGE FORMING APPARATUS

CROSS REFERENCE TO RELATED APPLICATION

This application claims priority from Japanese Patent Application No. 2005-159431, filed on May 31, 2005, the entire subject matter of which is incorporated herein by reference.

TECHNICAL FIELD

Aspects of the present invention relate to a sheet discharging device and an image forming apparatus having the sheet discharging device.

BACKGROUND

Conventionally, a sheet discharging device used in an image forming apparatus is generally provided with upper discharge roller pairs each having a driving discharge roller and a driven discharge roller brought into pressure contact therewith. Further, the following technique is known. That is, in order to provide a sheet being discharged with stiffness so as to prevent a leading end of the sheet being discharged from drooping down and from pushing out a sheet already discharged and placed on a discharge tray, the driving discharge rollers and the driven discharge rollers are arranged by being inclined by a predetermined angle θ. The driving discharge rollers and the driven discharge rollers are arranged symmetrically about a substantially central portion, in a widthwise direction perpendicular to a sheet transporting direction, of a sheet discharge path (e.g., JP-A-2004-35175). Specifically, two drive shafts of the driving discharge rollers are used, which are joined by a joint member in a state in which the drive shafts are inclined symmetrically about a widthwise substantially central portion of the sheet discharge path. According to such a construction, the driving discharge rollers and the driven discharge rollers are inclined, and the sheet is also curved in conformity with their inclination, so that the sheet is provided with stiffness and is discharged without drooping down.

SUMMARY

However, if a member for connecting the two drive shafts of the discharge rollers, such as a joint member, is used, the number of parts used and the number of man-hour increase, so that the manufacturing cost becomes high.

Aspects of the invention provide a sheet discharging device with discharge rollers, which makes it possible to lower the manufacturing cost as compared with a conventional example, as well as an image forming apparatus having such a sheet discharging device.

According to an aspect of the invention, there is provided a sheet discharging device including: a discharge roller that discharges a transported sheet to outside the sheet discharging device, the discharge roller being integrally formed with a flexible rotating shaft; first and second bearing members that rotatably hold one end side and another end side of the rotating shaft, respectively; a nipping member that nips the transported sheet in cooperation with the discharge roller, the nipping member being opposed to a peripheral surface of the discharge roller; and an abutment member abutting against one of the rotating shaft and the nipping member between the first bearing member and the second bearing member to curve the rotating shaft.

DETAILED DESCRIPTION

Hereafter, a description will be given of aspects of the invention with reference to the drawings.

[First Aspect]

(a) Overall Configuration

First, referring to FIGS. 1 and 2, a description will be given of the overview of a laser printer as an image forming apparatus in this aspect.

Figure 1:
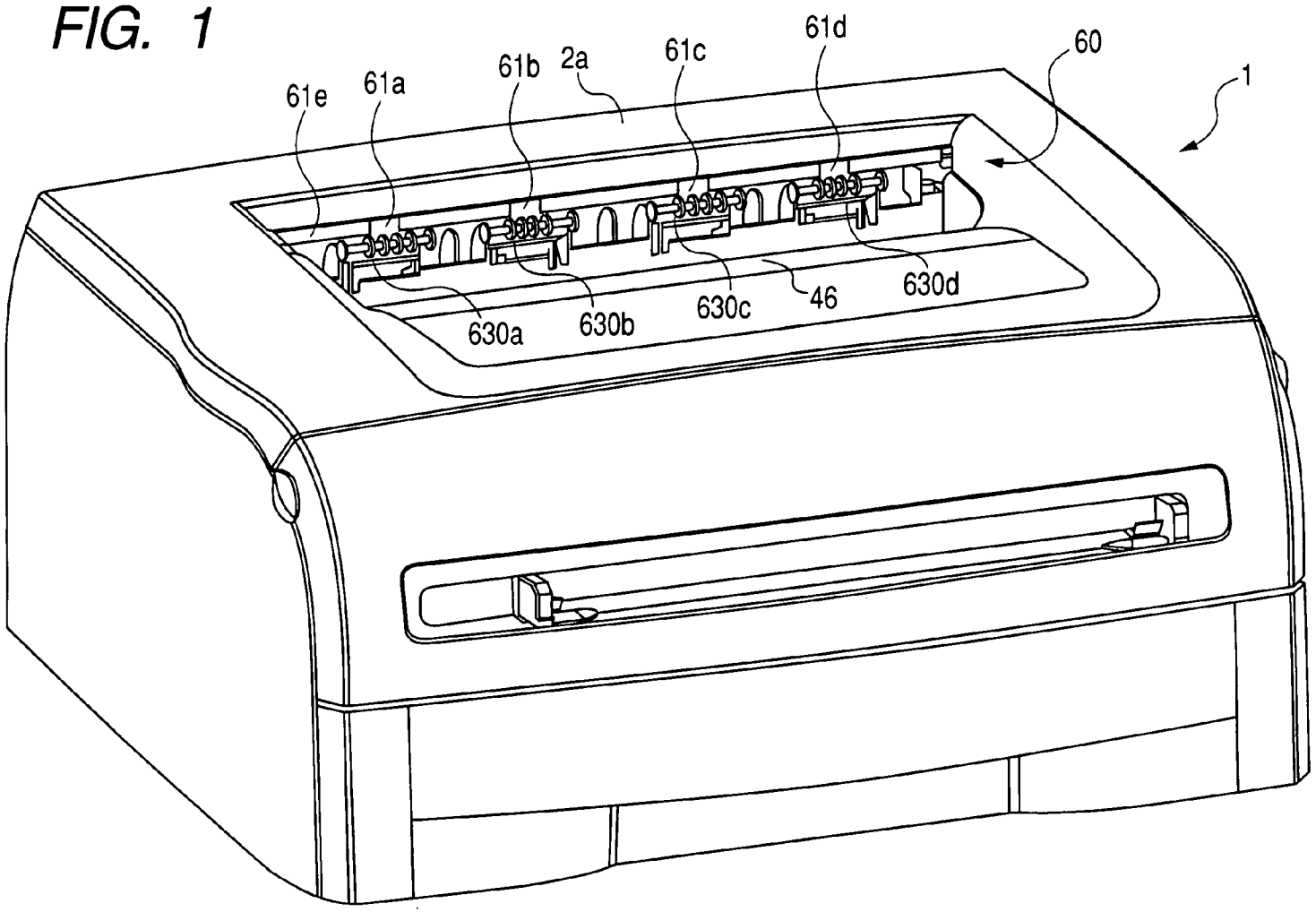
FIG. 1 is an external perspective view of a laser printer.

FIG. 1 is a perspective view illustrating the external appearance of a laser printer 1 (hereafter also referred to as the printer 1) as an image forming apparatus. FIG. 2 is a side cross-sectional view of the printer 1. In the description below, it is assumed that the right side in FIG. 2 is the front side of the printer 1, and the left side of the drawing is the rear side of the printer 1.

As shown in FIG. 1, the laser printer 1 has a body casing 2 that is box-shaped as a whole. Further, a feeder section 4 for feeding paper 3 as a sheet, an image forming section 5 for forming an image on the paper 3 fed, and the like are provided in the body casing 2. An opening 48 for performing the loading and unloading of a process cartridge 17 is provided in an upper portion of a front side (one side wall) of the body casing 2. A front cover 50 for covering this opening 48 is openably provided.

Figure 2:
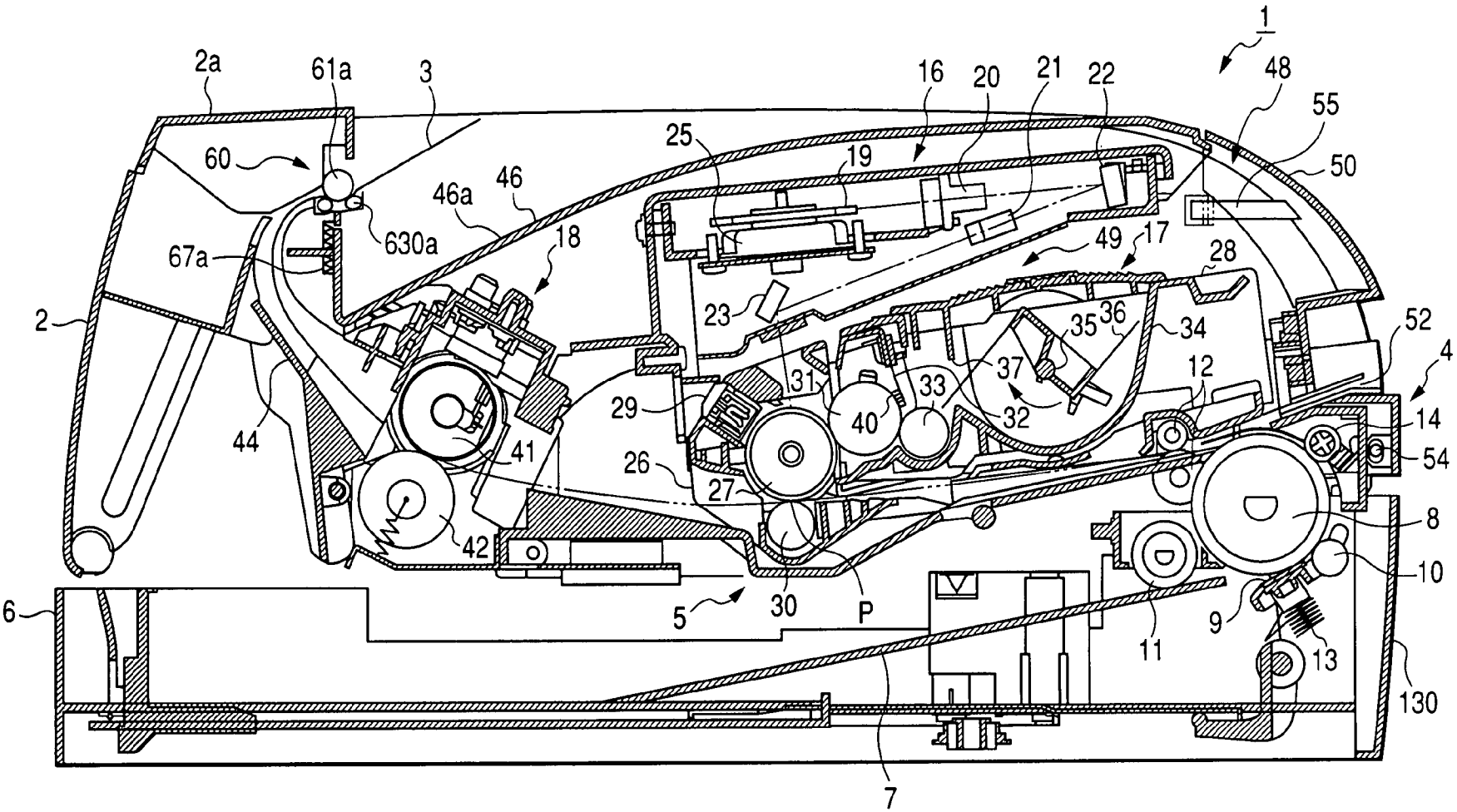
FIG. 2 is a cross-sectional view of the laser printer.

As shown in FIG. 2, the feeder section 4 includes a paper feed cassette 6; a paper pressing plate 7 provided in the paper feed cassette 6; a pickup roller 11 provided above one side end portion of the paper feed cassette 6; a paper feed roller 8 and a separation pad 9; a pinch roller 10 opposed to the paper feed roller 8; a paper dust removing roller 14; and a registration rollers 12 provided on the downstream side in the transporting direction of the paper 3 with respect to the paper dust removing roller 14.

The paper feed cassette 6 is detachably installed on the bottom portion inside the body casing 2 and is used to accommodate sheets of the paper 3 in a stacked state. A front surface wall 130 that is integrally molded from a synthetic resin material is provided at the front end of the paper feed cassette 6. This front surface wall 130 is formed in such a manner as to cover the front lower portion of the body casing 2 over the entire width in a state in which the paper feed cassette 6 is loaded in a proper loading position (the state shown in FIGS. 1 and 2). The front surface wall 130 is disposed at a position below the front cover 50. At the time of the replenishment of the paper 3 to the interior of the paper feed cassette 6, the paper feed cassette 6 is drawn out to the front side (right side in FIG. 2) of the printer 1. At this time, the feeder section 4 is separated between the paper feed roller 8 and the separation pad 9, and the pinch roller 10, the separation pad 9, and a spring 13 disposed on the back side of the separation pad 9 are drawn out as a unit together with the paper feed cassette 6.

As the paper pressing plate 7 is swingably supported at its end portion that is remote from the paper feed roller 8, an end portion of the paper pressing plate 7 close to the paper feed roller 8 is vertically movable and is upwardly urged by an unillustrated spring. For this reason, as the amount of sheets of the paper 3 stacked increases, the paper pressing plate 7 is downwardly swung against the urging force of the spring by using as a fulcrum its end portion that is remote from the paper feed roller 8.

The pickup roller 11 is set so as to abut against an uppermost one of the sheets of the paper 3 stacked in the paper feed cassette 6 by means of the paper pressing plate 7. The pickup roller 11 feeds the paper 3 to a position at which the paper 3 is transportable by the paper feed roller 8 (to the position between the paper feed roller 8 and the separation pad 9).

The separation pad 9 is disposed at a position opposing the paper feed roller 8. The separation pad 9 is pressed toward the paper feed roller 8 by the spring 13 disposed on the back side of the separation pad 9. In addition, this separation pad 9 has a function for preventing a plurality of sheets of the paper 3 from being fed into a transporting path in an overlapping state. Namely, the paper 3 that has been fed by the pickup roller 11 comes into contact with the paper feed roller 8 and the separation pad 9. At this time, since an appropriate frictional force is applied between the separation pad 9 and the paper 3, even if a plurality of sheets o the paper 3 are fed to the separation pad 9 by the pickup roller 11, the sheets of the paper 3 other than the uppermost sheet of the paper 3 are retained by the separation pad 9. For this reason, sheets of the paper 3 are fed one sheet at a time by the paper feed roller 8. Then, the paper 3 fed by the paper feed roller 8 is inverted so as to be turned back in the vicinity of the front end of the paper feed cassette 6, and after paper dust is removed by the paper dust removing roller 14, the paper 3 is fed to the registration rollers 12.

After the registration of the paper 3, the registration rollers 12 transport the paper 3 to a transfer position P which is located between a photosensitive drum 27 and a transfer roller 30 for transferring a toner image on the photosensitive drum 27 onto the paper 3.

The image forming section 5 includes a scanner unit 16, the process cartridge 17, and a fixing unit 18.

The scanner unit 16 is provided in an upper portion inside the body casing 2. The scanner unit 16 has a laser emitting portion (not shown), a polygon mirror 19 rotatably driven by a scanner motor 25, lenses 20 and 21, reflecting mirrors 22 and 23, and the like. A laser beam based on predetermined imaged at a emitted from the laser emitting portion is applied by high-speed scanning to the surface of the photosensitive drum 27 in the process cartridge 17 by being passed through or reflected by the polygon mirror 19, the lens 20, the reflecting mirror 22, the lens 21, and the reflecting mirror 23 in that order, as shown by the chain line in FIG. 2.

An accommodating portion 49 communicating with the opening 48 is formed in the body casing 2 below the scanner unit 16. The process cartridge 17 is detachably loaded in this accommodating portion 49. The process cartridge 17 includes a development cartridge 28 and a drum cartridge 26.

The development cartridge 28 has a development roller 31, a layer thickness regulating blade 32, a toner supply roller 33, a toner box 34, and the like. This development cartridge 28 is detachably mounted on the drum cartridge 26.

Toner (developer) is filled in the toner box 34. The toner in the toner box 34 is discharged from a toner supply port 37 provided in the toner box 34, as the toner is agitated by the rotation in the direction of the arrow (clockwise direction) by an agitator 36. The agitator 36 is supported by a shaft 35 provided in the center of the toner box 34.

The toner supply roller 33 is provided at a lateral position of the toner supply port 37. The toner supply roller 33 is rotatable in the counterclockwise direction. The development roller 31 is disposed in face-to-face relation to this toner supply roller 33 and is rotatable in the counterclockwise direction. The toner supply roller 33 and the development roller 31 are abutted against each other in such a state that they are compressed to some extent.

As for the toner supply roller 33, a metallic roller shaft is covered with a roller formed of an electrically conductive foaming material. As for the development roller 31, a metallic roller shaft is covered with a roller formed of an electrically conductive rubber material that does not have magnetic properties. More specifically, as for the roller portion of the development roller 31, the surface of a roller body formed of electrically urethane rubber or silicone rubber containing carbon particles is covered with a coating layer of urethane rubber or silicone rubber containing fluorine. It should be noted that a development bias is applied to the development roller 31.

In addition, the layer thickness regulating blade 32 is disposed in the vicinity of the development roller 31. This layer thickness regulating blade 32 has a pressing portion 40 having a semicircular cross section and made of insulating silicone rubber. The pressing portion 40 is provided at a distal end portion of a blade body formed of a metallic leaf spring material. The layer thickness regulating blade 32 is supported by the development cartridge 28 in the vicinity of the development roller 31. The pressing portion 40 is arranged to be brought into pressure contact with the development roller 31 by the resiliency of the blade body.

The toner discharged from the toner supply port 37 is supplied to the development roller 31 by the rotation of the toner supply roller 33. At this time, the toner is frictionally charged positively between the toner supply roller 33 and the development roller 31. Further, the toner supplied onto the development roller 31 advances into the nip between the development roller 31 and the pressing portion 40 of the layer thickness regulating blade 32 in conjunction with the rotation of the development roller 31, and here the toner is further frictionally charged sufficiently and is carried on the development roller 31 with a thin layer of a fixed thickness.

The drum cartridge 26 has the photosensitive drum 27 serving as an image carrier, a scorotron charger 29, the transfer roller 30, and the like.

The photosensitive drum 27 is disposed at a lateral position of the development roller 31 in face-to-face relation to the development roller 31 in such a manner as to be rotatable in the clockwise direction. As for this photosensitive drum 27, its drum body is grounded, and its surface portion is formed by a positively chargeable photosensitive layer formed by polycarbonate or the like.

The scorotron charger 29 is disposed at a predetermined interval with the photosensitive drum 27 so as not to come into contact with it. This scorotron charger 29 is disposed at a position approximately 30 degrees upward from the horizontal direction in the radial direction of the photosensitive drum 27. This scorotron charger 29 is a positively charging scorotron type charger for generating a corona discharge from a charging wire made of tungsten or the like. The scorotron charger 29 is so constructed as to positively charge the surface of the photosensitive drum 27 uniformly.

After the surface of the photosensitive drum 27 is first positively charged uniformly by the scorotron charger 29 in conjunction with the rotation of the photosensitive drum 27, the surface of the photosensitive drum 27 is exposed by high-speed scanning involving the turning on and off of the laser beam from the scanner unit 16 on the basis of image data inputted from the outside, thereby forming an electrostatic latent image based on the image data.

Next, as the development roller 31 rotates, the toner being carried on the development roller 31 and being positively charged is supplied to an electrostatic latent image formed on the surface of the photosensitive drum 27, i.e., to an exposed portion where the potential is lowered on exposure by the laser beam on the surface of the photosensitive drum 27 positively charged uniformly, thereby allowing the toner to be selectively carried on the photosensitive drum 27 as a visible image. Thus, reversal development can be attained.

The transfer roller 30 is disposed below the photosensitive drum 27 in face-to-face relation to the photosensitive drum 27 and is supported by the drum cartridge 26. The transfer roller 30 is rotatable in the counterclockwise direction. As for this transfer roller 30, a metallic roller shaft is covered with a roller formed of an ion conducting rubber material. A transfer bias (transfer forward bias) is applied to the transfer roller 30 during transfer. For this reason, the visible image carried on the surface of the photosensitive drum 27 is transferred onto the paper while the paper 3 passes between the photosensitive drum 27 and the transfer roller 30.

The fixing unit 18 is provided on the rear side on the process cartridge 17. The fixing unit 18 has a heat roller 41 and a pressure roller 42.

The heat roller 41 has a metal pipe whose surface is coated with a fluororesin as well as a halogen lamp provided in the metal pipe for heating. The heat roller 41 is rotatively driven by the input of power from an unillustrated motor. Meanwhile, the pressure roller 42 is disposed below the heat roller 41 in face-to-face relation thereto so as to press the heat roller 41. This pressure roller 42 is constructed by covering a metallic roller shaft with a roller formed of a rubber material. The pressure roller 42 is driven in accordance with the rotative driving of the heat roller 41.

In the fixing unit 18, the toner transferred onto the paper 3 at a transfer position is thermally fixed while the paper 3 passes between the heat roller 41 and the pressure roller 42. The paper 3 with the toner fixed thereon is transferred to a sheet discharge path 44 extending upwardly. The paper 3 transported to the sheet discharge path 44 is discharged onto a paper discharge tray 46, which is formed on the upper surface of the body casing 2, by a paper discharge unit 60 provided at an upper end position of the sheet discharge path 44.

(b) Paper Discharge Unit

Next, referring to FIGS. 2 to 6, a detailed description will be given of the paper discharge unit 60 as a sheet discharging device.

Figure 3:
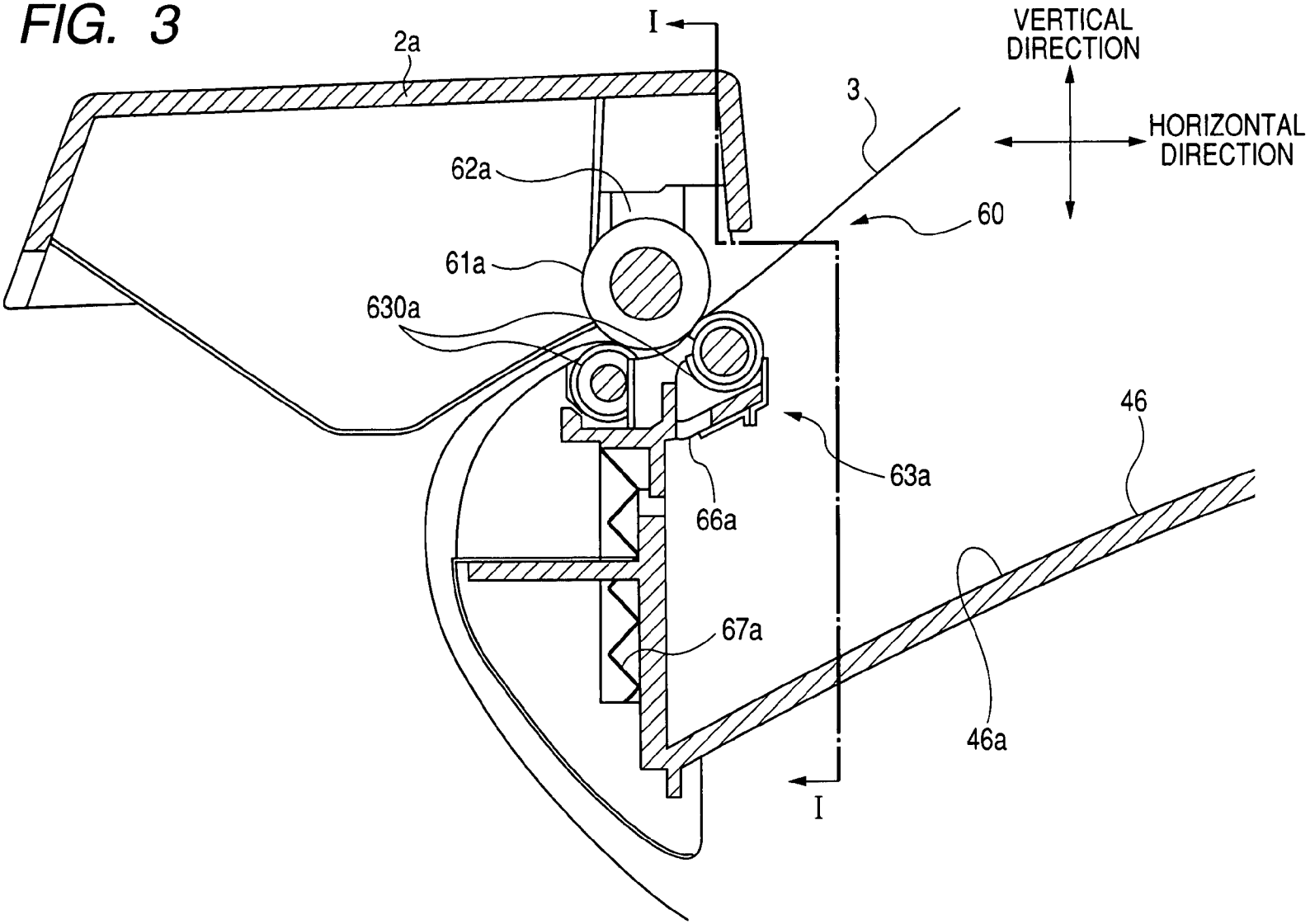
FIG. 3 is an enlarged view of a paper discharge unit shown in FIG. 2.
Figure 4:
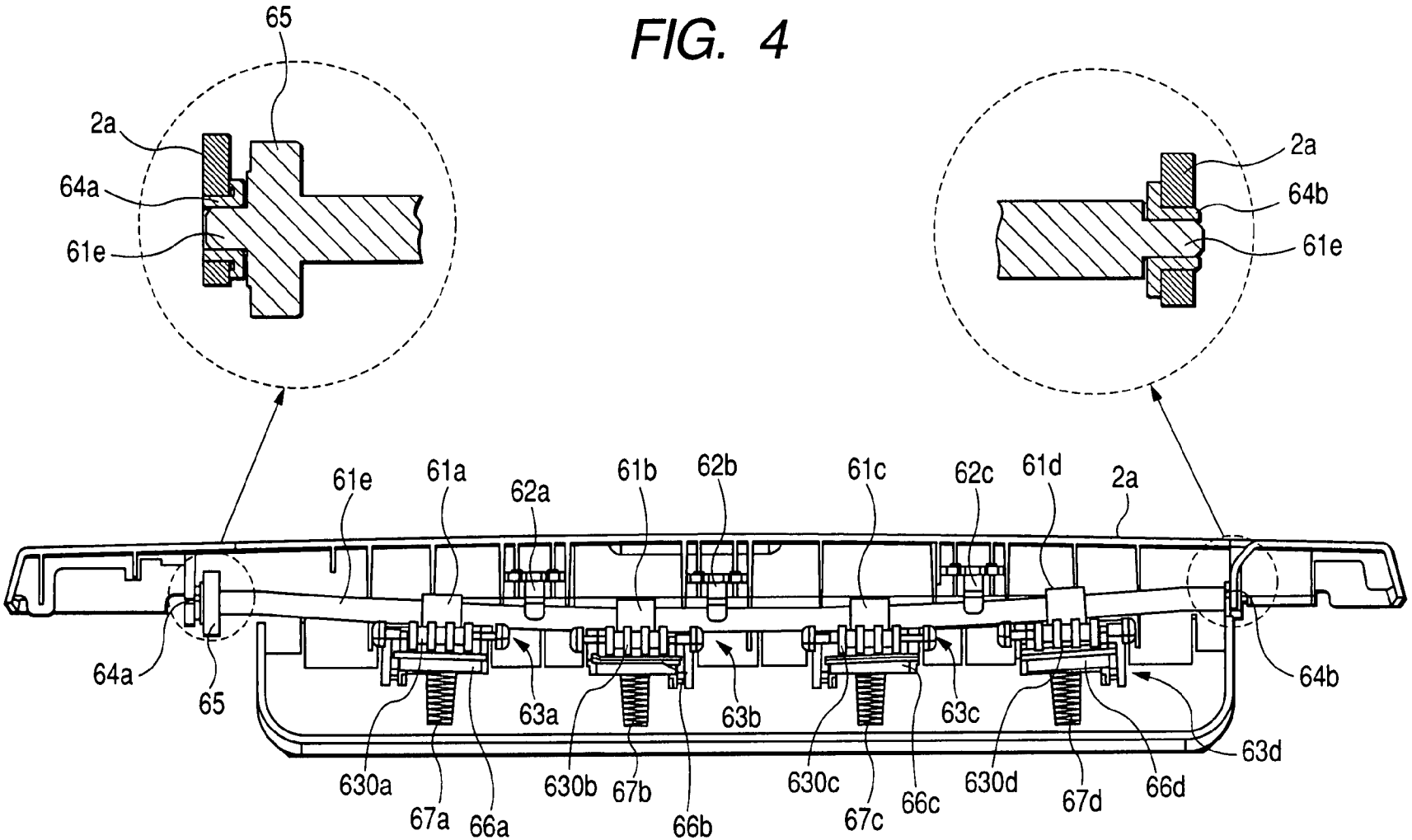
FIG. 4 is a cross-sectional view taken along line I-I in FIG. 3, the curve of a rotating shaft being shown exaggerated.

FIG. 3 is an enlarged view of the paper discharge unit 60 shown in FIG. 2. FIG. 4 is a cross-sectional view taken along line I-I in FIG. 3, and the curve of a rotating shaft 61*e* is exaggerated for the purposes of illustration. (Portions surrounded by large broken-line circles are enlarged cross-sectional views of portions surrounded by small broken-line circles.)

As shown in FIGS. 3 and 4, the paper discharge unit 60 includes four discharge rollers 61*a* to 61*d* that are driven by an unillustrated motor disposed in the printer 1 and discharge the paper 3 to outside the device in a direction having a horizontal component. The paper discharge unit 60 further includes: support members 62*a* to 62*c* serving as abutment members for supporting the rotating shaft 61*e* of the discharge rollers 61*a* to 61*d* with the rotating shaft 61*e* curved in the vertical direction; and nipping members 63*a* to 63*d*, which are respectively disposed in face-to-face relation to peripheral surfaces of the discharge rollers 61*a* to 61*d* and are adapted to nip the transported paper 3 in cooperation with the respective discharge rollers 61*a* to 61*d*.

The discharge rollers 61*a* to 61*d* and the rotating shaft 61*e* are integrally formed of a flexible material. Both ends of the rotating shaft 61*e* are rotatably held by a first bearing member 64*a* and a second bearing member 64*b*, respectively, as shown by the portions surrounded by the broken-line circles in FIG. 4. The first bearing member 64*a* and the second bearing member 64*b* are each interposed slidably between the rotating shaft 61*e* and a hole provided in a downwardly projecting portion of an upper cover 2*a*. A gear 65 for transmitting the driving force from the unillustrated motor in the printer 1 to the rotating shaft 61*e* is mounted in the vicinity of one end portion of the rotating shaft 61*e*.

The discharge rollers 61*a* to 61*d* may be formed of EPDM (etylene propylene diene terpolymer). The rotating shaft 61*e* may be formed of resin materials that have high wear resistance, such as PC (polycarbonate).

As illustrated in FIG. 3, the nipping member 63*a* has a pair of driven rollers 630*a* disposed in face-to-face relation to the peripheral surface of the discharge roller 61*a* and adapted to abut against the paper 3. The nipping member 63*a* also has a holder 66*a* for rotatably holding the pair of driven rollers 630*a*, respectively. The lower surface of the holder 66*a* is urged in a vertically upward direction, i.e., toward the discharge roller 61*a*, by a spring 67*a* that serves as an urging member and a elastic member and whose one end is fixed to the body casing 2. The nipping members 63*b* to 63*d* are constructed in the same way as the nipping member 63*a* and are respectively disposed in face-to-face relation to the peripheral surfaces of the four discharge rollers 61*b* to 61*d*, as shown in FIG. 4.

Figure 5:
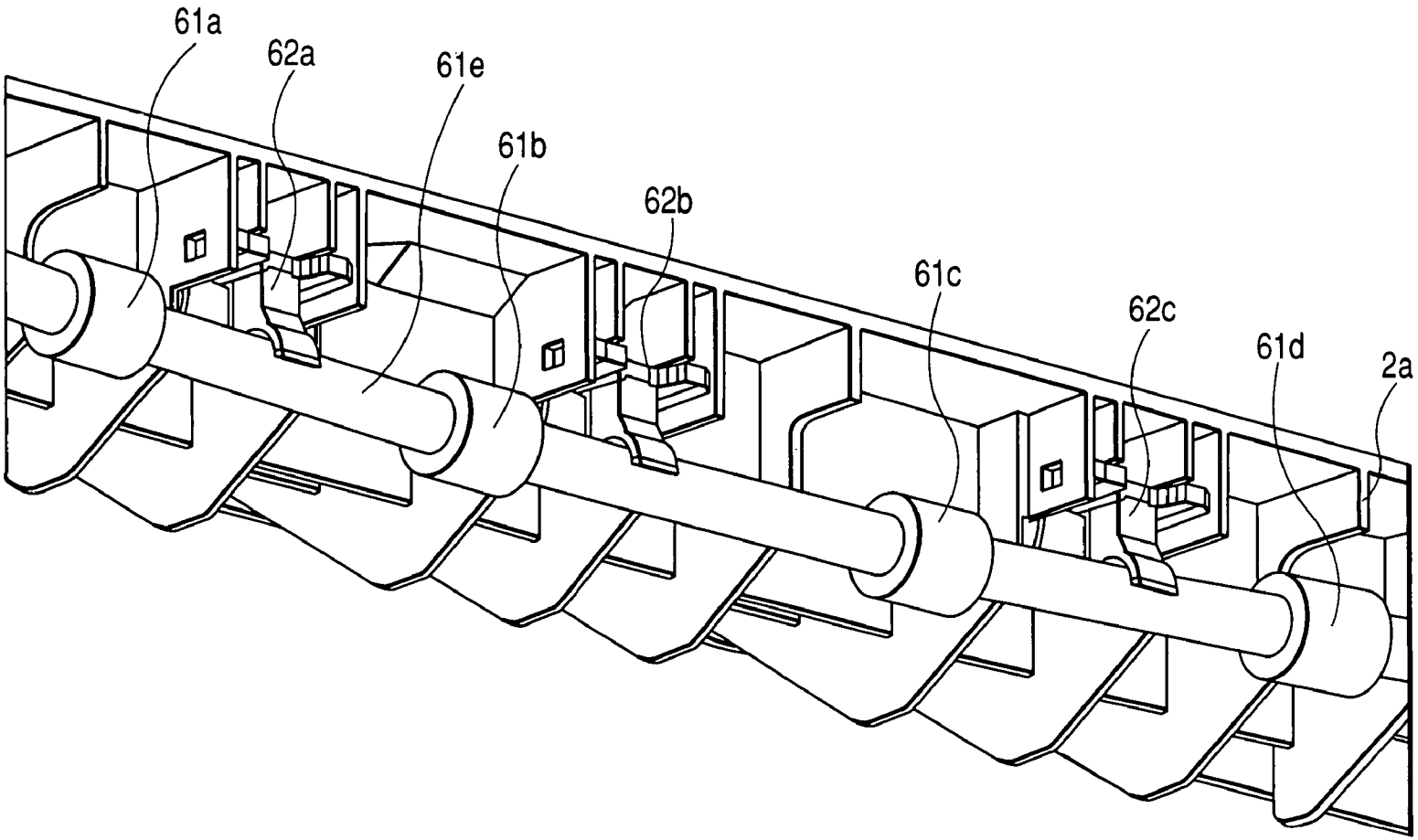
FIG. 5 is a perspective view of discharge rollers and support members.

FIG. 5 is a perspective view of the discharge rollers 61*a* to 61*d* and the support members 62*a* to 62*c*.

As shown in FIG. 5, the supporting members 62*a* to 62*c* are attached to the body casing 2. Each of the three supporting members 62*a* to 62*c* is disposed between adjacent ones of the discharge rollers 61*a* to 61*d* so as to rotatably support the rotating shaft 61*e*. The supporting members 62*a* to 62*c* have cavities conforming to the outer periphery of the rotating shaft 61*e* and support the rotating shaft 61*e* at these cavities.

The cavities of the supporting members 62*a* and 62*c* among the supporting members 62*a* to 62*c* are respectively disposed vertically downwardly of the first bearing member 64*a* and the second bearing member 64*b*. The cavity of the supporting member 62*b* is disposed further vertically downwardly of the cavities of the supporting members 62*a* and 62*c*. Namely, the supporting members 62*a* to 62*c* support the rotating shaft 61*e* vertically downwardly of the first bearing member 64*a* and the second bearing member 64*b*. Accordingly, the rotating shaft 61*e* is supported such that its central portion is curved so as to bulge vertically downward relative to the first bearing member 64*a* and the second bearing member 64*b*. The central portion of the rotating shaft 61*e* bulges relative to the first bearing member 64*a* and the second bearing member 64*b*, for example, about 0.05 mm-1 mm. In addition, peripheral surfaces of the discharge rollers 61*a* to 61*d* and peripheral surfaces of the driven roller pairs 630*a* to 630*d*, which are respectively brought into pressure contact with the discharge rollers 61*a* to 61*d*, are respectively inclined along the curve of this rotating shaft 61*e*.

Next, a description will be given of the paper discharging operation of the paper discharge unit 60.

The paper 3, which has passed along the discharge path 44 after the image had been formed on its surface, is nipped between the discharge rollers 61*a* to 61*d* and the nipping members 63*a* to 63*d*, which are provided in four sets. At this time, the peripheral surfaces of the discharge rollers 61*a* to 61*d* and the peripheral surfaces of the driven roller pairs 630*a* to 630*d* are inclined along the curve of the rotating shaft 61*e*. Accordingly, a central portion, in the widthwise direction perpendicular to the paper transporting direction (the term "widthwise" or "widthwise direction" used hereafter is meant to refer to this widthwise direction), of the paper 3 being nipped between the discharge rollers 61*a* to 61*d* and the nipping members 63*a* to 63*d* becomes curved so as to bulge downward relative to both widthwise end portions thereof.

Figure 6:
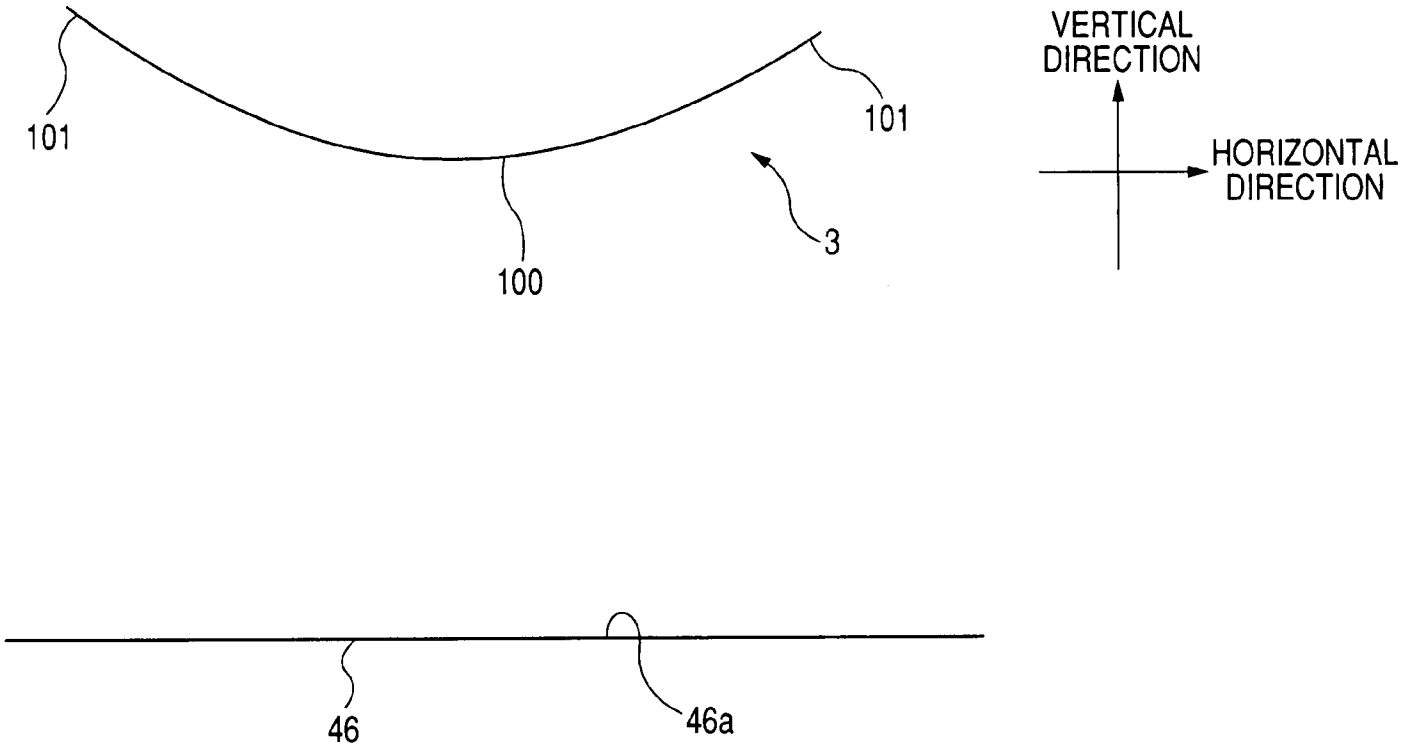
FIG. 6 is a cross-sectional view, taken along a plane perpendicular to a paper transporting direction, of that portion of paper that has passed through the discharge unit, the curve of the paper being shown exaggerated.

FIG. 6 is a cross-sectional view, taken along a plane perpendicular to the paper transporting direction, of that portion of the paper 3 that has passed through the discharge unit 60 in accordance with the first aspect. It should be noted, however, that the curve of the paper 3 is exaggerated for the purposes of illustration.

As shown in FIG. 6, also as for the portion of the paper 3 that has passed through the discharge rollers 61*a* to 61*d*, its widthwise central portion forms a convex portion 100 projecting toward a placing surface 46*a* of the discharge tray 46. Meanwhile, both widthwise end portions 101 of the paper 3 are positioned farther away from the placing surface 46*a* than the convex portion 100.

Next, a description will be given of advantages derived from the construction of this aspect.

Since the rotating shaft 61*e* is curved in the vertical direction by the supporting members 62*a* to 62*c*, the paper 3 that is discharged by the discharge rollers 61*a* to 61*d* also becomes curved vertically as viewed in the widthwise direction, so that stiffness is formed in the paper 3. Further, since the rotating shaft 61*e* is flexible and is integrally formed, a member for connecting the shafts, which is required in JP-A-2004-35175, becomes unnecessary, thereby making it possible to reduce the manufacturing cost.

Since the supporting members 62*a* to 62*c* are provided that support the rotating shaft 61*e* at vertically different positions relative to the first bearing member 64*a* and the second bearing member 64*b*, the supporting members 62*a* to 62*c* are capable of curving the rotating shaft 61*e* in the vertical direction.

Since the urging members has the springs 67*a* to 67*d* as the elastic members, and the springs 67*a* to 67*d* respectively urge the discharge rollers 61*a* to 61*d* vertically upward through the nipping members 63*a* to 63*d*, it is possible to deflect the rotating shaft 61*e*. Further, since the springs 67*a* to 67*d* that are elastic members are used as the urging members, the construction can be simple as compared with a case where the rotating shaft 61*e* is deflected by using solenoids or the like.

Since the nipping members 63*a* to 63*d* are provided with the driven roller pairs 630*a* to 630*d* that are abutted against the paper 3 and are respectively rotatably supported by the holders 66*a* to 66*d*, the transport of the paper 3 becomes smooth.

As shown in FIG. 6, as for the portion of the paper 3 that has passed through the paper discharge unit 60, its curved convex portion 100 projects toward the placing surface 46*a* of the discharge tray 46, while the both widthwise end portions 101 are positioned farther away from the placing surface 46*a* than the convex portion 100. Therefore, as compared with a case where the both end portions 101 are closer to the placing surface 46*a* than the convex portion 100, the stiffness of the paper 3 does not become weak even if gravity is applied to the paper 3.

[Second Aspect]

Next, a description will be given of a second aspect with reference to FIG. 7. A description of those portions that are common to the first aspect will be omitted.

Figure 7:
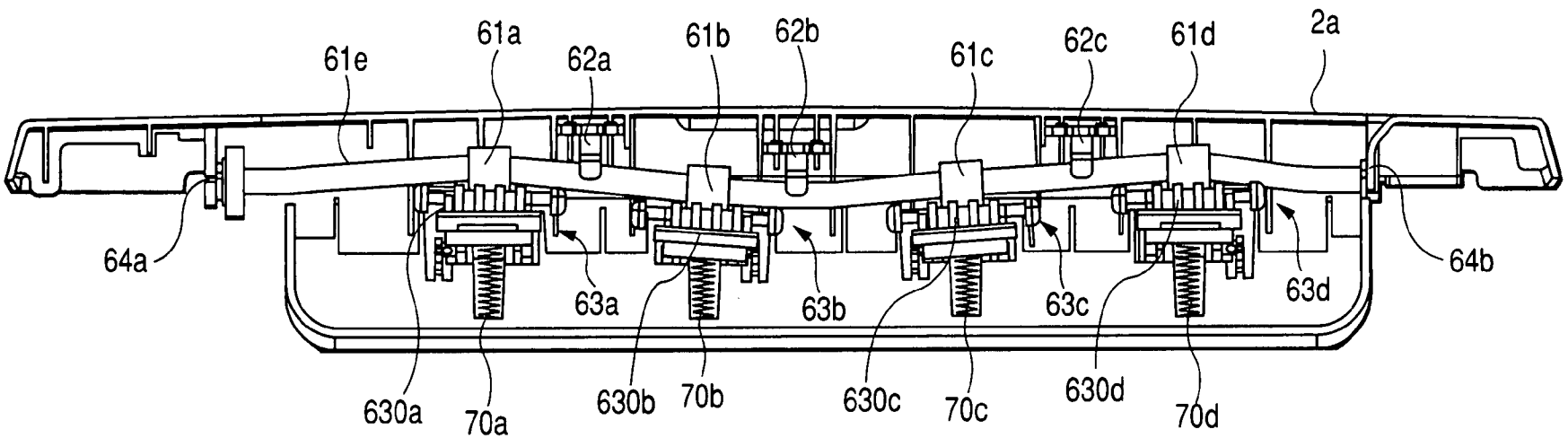
FIG. 7 is a cross-sectional view taken along line I-I in FIG. 3, the curve of a rotating shaft being shown exaggerated (second aspect)

FIG. 7 is a cross-sectional view taken along line I-I in FIG. 3 in the second aspect, and the curve of the rotating shaft 61*e* is exaggerated for the purposes of illustration.

In the second aspect as well, springs 70*a* to 70*d*, which serve as urging members for respectively urging the holders 66*a* to 66*d* and as elastic members, are provided. However, these springs 70*a* to 70*d* have greater moduli of elasticity than the springs 67*a* to 67*d* in the first aspect, and press the nipping members 63*a* to 63*d* more strongly toward the discharge rollers 61*a* to 61*d*.

Figure 8:
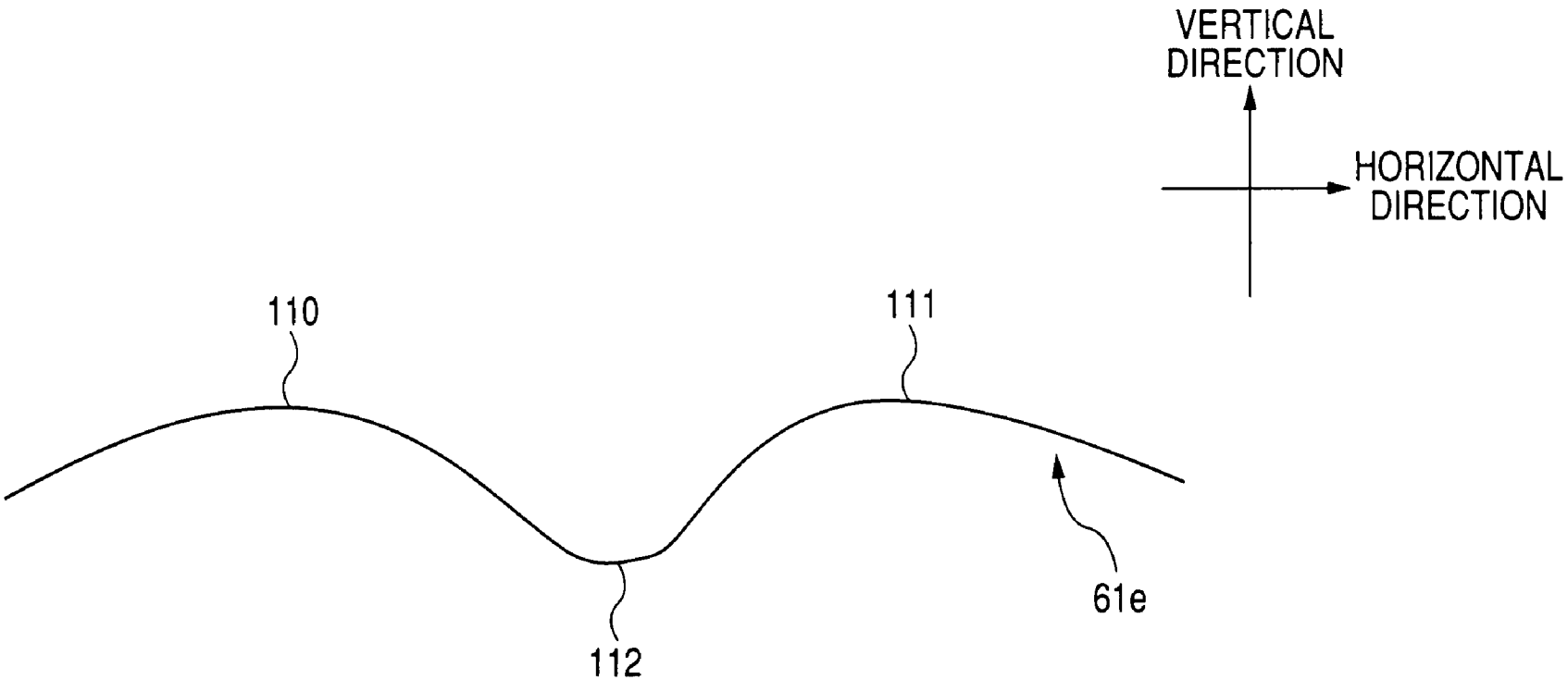
FIG. 8 is a schematic diagram illustrating a curved state of the rotating shaft, the curve of the rotating shaft being shown exaggerated (second aspect)

FIG. 8 is a schematic diagram illustrating a curved state of the rotating shaft 61*e* in accordance with the second aspect. The curve of the rotating shaft 61*e* is exaggerated for the purposes of illustration.

In the second aspect, the rotating shaft 61*e* is curved so as to have three loop portions 110, 111, and 112.

Specifically, the rotating shaft 61*e* that is urged by the springs 70*a* and 70*d* through the nipping members 61*a* and 61*d* has the loop portions 110 and 111, which are formed so as to bulge upward. A central portion of the rotating shaft 61*e* that is supported by the supporting member 62*b* downwardly of the first bearing member 64*a* and the second bearing member 64*b* has the loop portion 112, which is formed so as to bulge downward.

Further, the peripheral surfaces of the discharge rollers 61*a* to 61*d* and the peripheral surfaces of the driven roller pairs 630*a* to 630*d*, which are respectively brought into pressure contact with the discharge rollers 61*a* to 61*d*, are inclined along the curve of this rotating shaft 61*e*.

Accordingly, the paper 3 being nipped between the discharge rollers 61*a* to 61*d* and the driven roller pairs 630*a* to 630*d* also becomes curved in conformity with the inclination of the peripheral surfaces of the discharge rollers 61*a* to 61*d*. In addition, the portion of the paper 3 that has passed through the discharge rollers 61*a* to 61*d* also keeps its curved state as it is.

Figure 9:
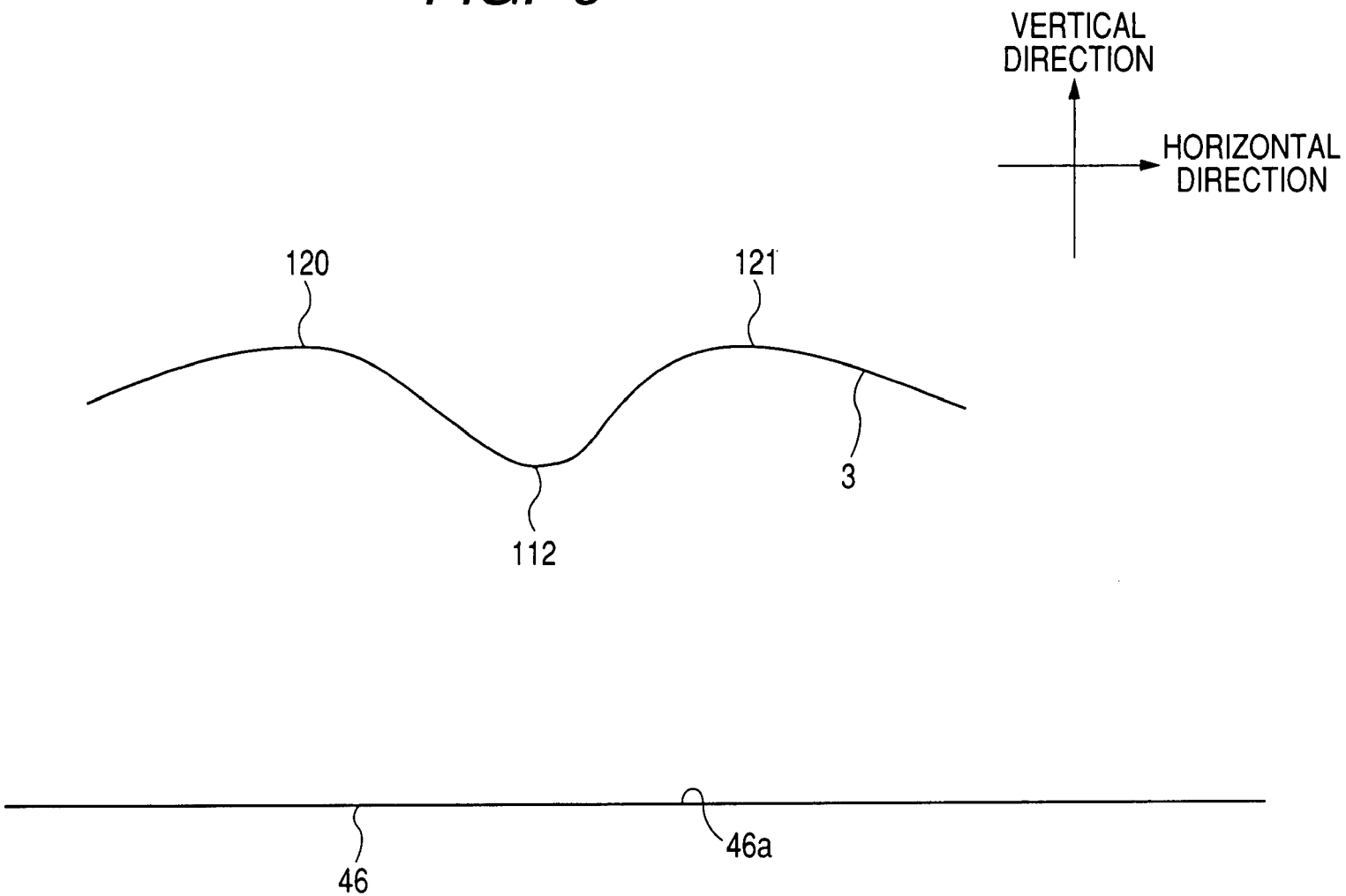
FIG. 9 is a cross-sectional view, taken along a plane perpendicular to the paper transporting direction, of that portion of the paper that has passed through the discharge unit, the curve of the paper being shown exaggerated (second aspect)

FIG. 9 is a cross-sectional view, taken along a plane perpendicular to the paper transporting direction, of that portion of the paper 3 that has passed through the discharge unit 60 in accordance with the second aspect. The curve of the paper 3 is exaggerated for the purposes of illustration.

Since the rotating shaft 61*e* is curved so as to have the loop portions 110 to 112, the paper 3 that is discharged also comes to have convex portions 120 to 122 formed in such a manner as to bulge vertically relative to its both end portions 123 in respective correspondence with the ridge portions 110 to 112. Thus the stiffness of the paper 3 becomes stronger.

[Third Aspect]

Next, a description will be given of a third aspect with reference to FIGS. 10A and 10B.

Figure 10A:
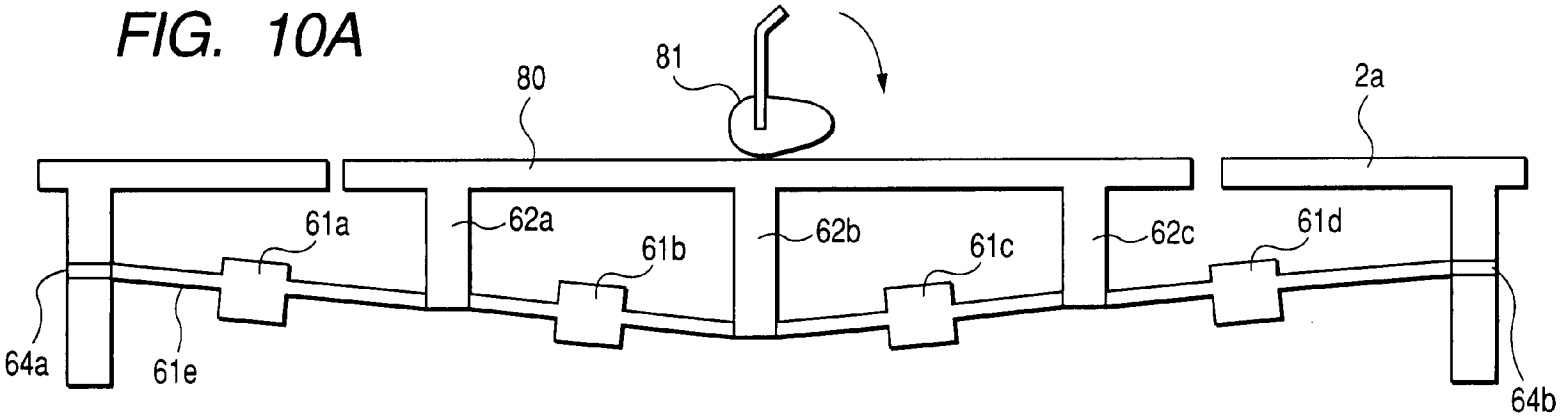
FIGS. 10A and 10B are diagrams respectively illustrating a state in which a base is fixed at an upper position and a state in which the base is supported at a lower position (third aspect)
Figure 10B:
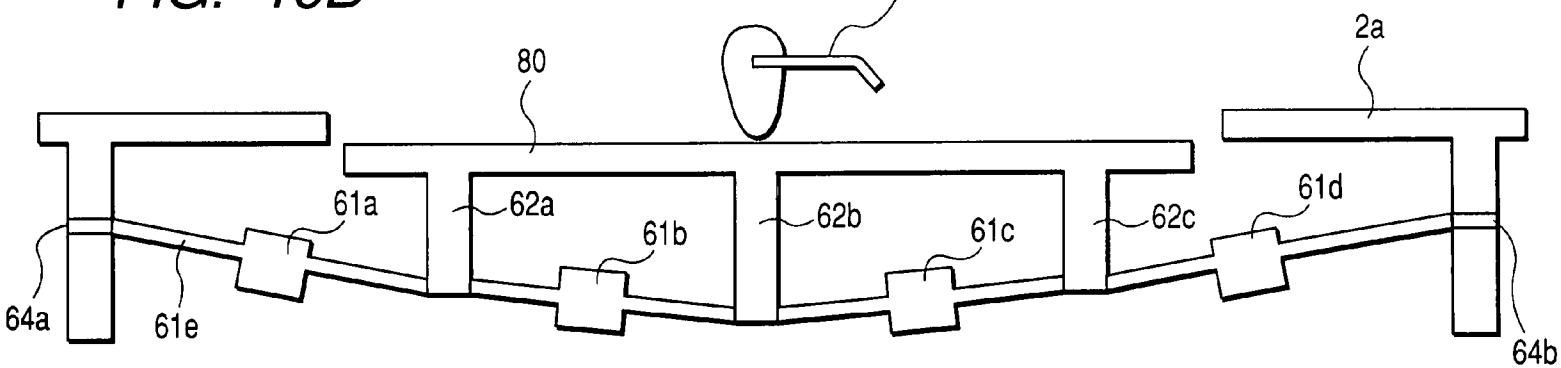

FIG. 10A is a diagram illustrating a state in which a base 80 is fixed at an upper position. FIG. 10B is a diagram illustrating a state in which the base 80 is supported at a lower position.

The supporting members 62*a* to 62*c* are fixed to the base 80 that is vertically movable relative to the upper cover 2*a*. A cam 81 is provided in a central portion of an upper surface of the base 80. The cam 81 serves as a position adjusting unit for adjusting the amount of deflection of the rotating shaft 61*e* by adjusting the vertical position of the base 80 in two stages. In a case where paper having strong stiffness such as a postcard is discharged, the base 80 is fixed at the upper position, as shown in FIG. 10A. In a case where paper having weak stiffness such as plain paper is discharged, the base 80 is fixed at the lower position, as shown in FIG. 10B. When the base 80 is at the lower position, the amount of deflection of the rotating shaft 61*e* is large as compared with the case where the base 80 is at the upper position, so that it is possible to allow the plain paper to be reliably provided with stiffness.

[Fourth Aspect]

Next, a description will be given of a fourth aspect with reference to FIGS. 11A and 11B.

Figure 11A:
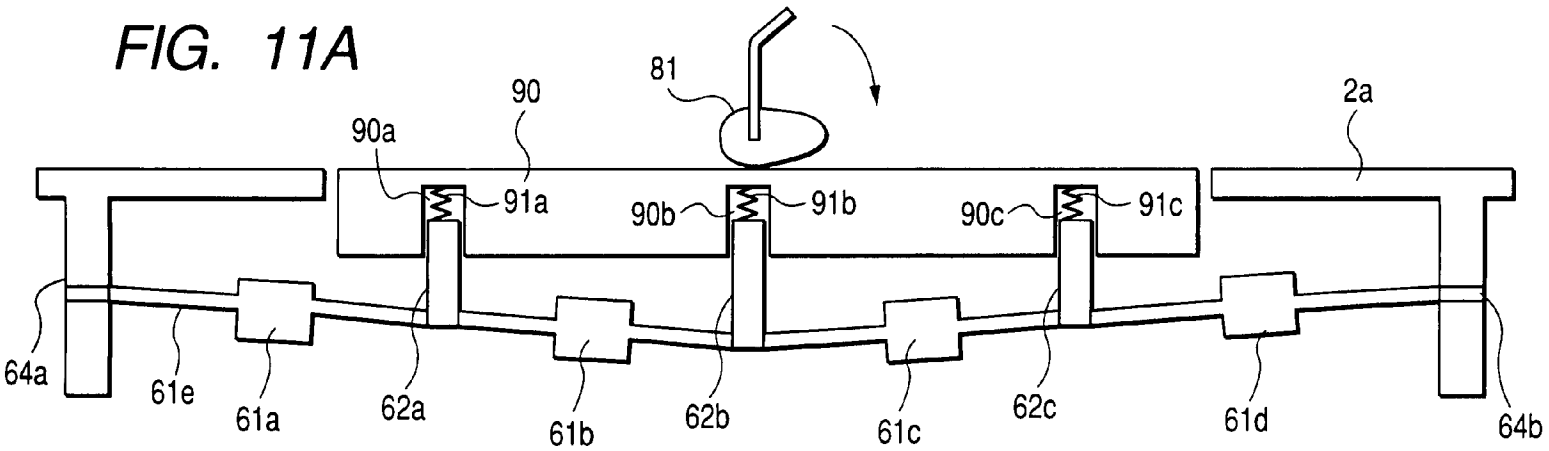
FIGS. 11A and 11B are diagrams respectively illustrating a state in which a base is fixed at the upper position and a state in which the base is supported at the lower position (fourth aspect)
Figure 11B:
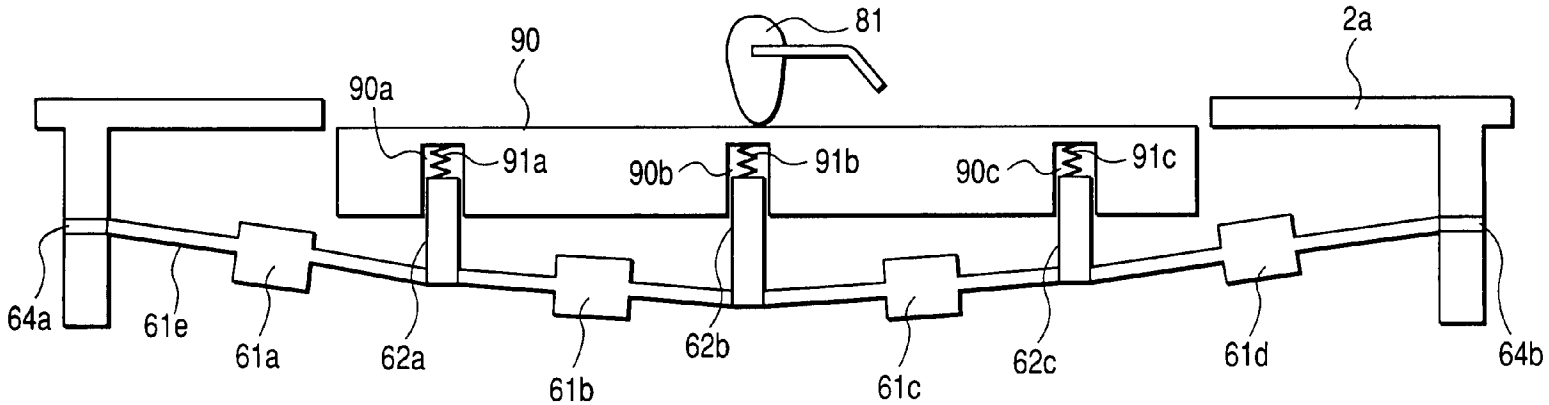

FIG. 11A is a diagram illustrating a state in which a base 90 is fixed at the upper position. FIG. 11B is a diagram illustrating a state in which the base 90 is supported at the lower position.

The supporting members 62*a* to 62*c* and springs 91*a* to 91*c*, which serve as elastic members for respectively urging the supporting members 62*a* to 62*c* toward the rotating shaft 61*e*, are provided in grooves 90*a* to 90*c* formed in the base 90 that is vertically movable relative to the upper cover 2*a*.

Since the supporting members 62*a* to 62*c* are respectively urged by the springs 91*a* to 91*c*, the manner of deflection of the rotating shaft 61*e* is better adapted to produce the aimed-at stiffness of the paper 3.

Although a number of aspects have been described above, the invention is not limited thereto.

Although the rotating shaft 61*e* and the discharge rollers 61*a* to 61*d* are integrally formed collectively, only the rotating shaft may be integrally formed from a flexible material, and the discharge rollers may be fitted thereto.

As for the springs 67*a* to 67*d* for urging the nipping members 63*a* to 63*d*, those having different urging forces may be used. In that case, the rotating shaft 61*e* can be deflected in a various shape.

Figure 12:
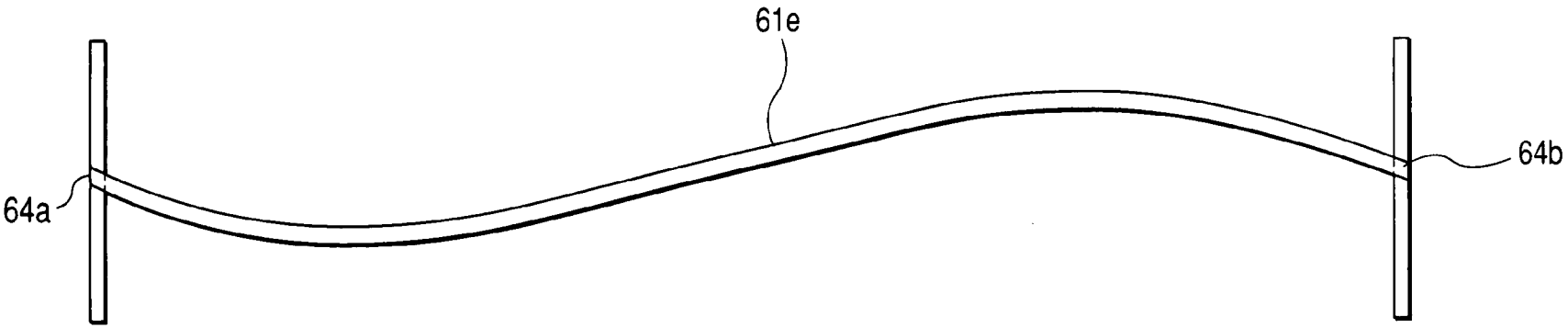
FIG. 12 is a diagram schematically representing the shape of a rotating shaft (a further aspect).

The rotating shaft 61*e* may be deflected in a shape such as the one shown in FIG. 12. Here, FIG. 12 is a diagram schematically representing the shape of the rotating shaft 61*e*.

In addition, in this specification, the term "curve" and the term "deflect" are treated as having the same meanings.

Incidentally, the present invention is also applicable to a sorter and other types of image forming apparatus including an ink-jet printer.

What is claimed is:

1. A sheet discharging device comprising:

a discharge roller that discharges a transported sheet to outside the sheet discharging device, the discharge roller having a flexible rotating shaft;

first and second bearing members that rotatably hold one end side and another end side of the flexible rotating shaft, respectively;

a nipping member that nips the transported sheet in cooperation with the discharge roller, the nipping member being opposed to a peripheral surface of the discharge roller;

an abutment member abutting against the flexible rotating shaft between the first bearing member and the second bearing member to curve the flexible rotating shaft, wherein:

the flexible rotating shaft is a drive rotating shaft to which a drive force of a motor is transmitted and which rotates based on the drive force, the flexible rotating shaft being curved by a force applied by the abutment member, the nipping member is a driven roller that rotates in accordance with a rotation of the discharge roller, the discharge roller comprises a plurality of discharge rollers which are provided on the flexible rotating shaft along an axis direction of the flexible rotating shaft, the abutment member comes in contact with the flexible rotating shaft in an area formed between the plurality of discharge rollers, the abutment member comprises an urging member that urges the flexible rotating shaft in a substantially vertical direction, and the urging member comprises a plurality of urging members provided at intervals along a direction of the flexible rotating shaft, and the plurality of urging members have mutually different urging forces.

2. The sheet discharging device according to claim 1, wherein the abutment member comprises a supporting member that supports the flexible rotating shaft at a vertically different position relative to the first bearing member and the second bearing member.

3. The sheet discharging device according to claim 1, wherein the urging member comprises an elastic member that urges the flexible rotating shaft in a substantially vertical direction.

4. The sheet discharging device according to claim 1, wherein the nipping member comprises:

a roller abutting against a sheet surface; and a holder for rotatably supporting the roller.

5. The sheet discharging device according to claim 1, further comprising a discharge tray on which the sheet discharged by the discharge roller is placed, the discharge tray being provided below the discharge roller, wherein the abutment member is disposed at a position for deflecting the flexible rotating shaft such that a curved convex portion of the discharged sheet projects toward the discharge tray, while both widthwise end portions, in a direction perpendicular to a transporting direction, of the discharged sheet are positioned farther away from the discharge tray than the convex portion.

6. The sheet discharging device according to claim 1, wherein the abutment member comprises a supporting member integrally formed with a cover on which a discharge tray is formed.

7. The sheet discharging device according to claim 1, wherein the abutment member has a recess portion, and the flexible rotating shaft is curved by fitting the recess portion on the flexible rotating shaft.

8. The sheet discharging device according to claim 7, wherein the recess portion has a shape that is configured to be engaged with the flexible rotating shaft.

9. The sheet discharging device according to claim 1, wherein the flexible rotating shaft is formed of a resin material.

10. The sheet discharging device according to claim 1, wherein the abutment member comprises a plurality of abutment members that are provided at intervals along a longitudinal direction of the flexible rotating shaft so that the flexible rotating shaft is curved with a plurality of loop portions between the first bearing member and the second bearing member.

11. An image forming apparatus comprising:

an image forming section for forming an image on a sheet surface; and a sheet discharging device that comprises:

a discharge roller that discharges a transported sheet to outside the sheet discharging device, the discharge roller having a flexible rotating shaft;

first and second bearing members that rotatably hold one end side and another end side of the flexible rotating shaft, respectively;

a nipping member that nips the transported sheet in cooperation with the discharge roller, the nipping member being opposed to a peripheral surface of the discharge roller;

an abutment member abutting against the flexible rotating shaft between the first bearing member and the second bearing member to apply a force to curve the flexible rotating shaft, wherein:

the flexible rotating shaft is a drive rotating shaft to which a drive force of a motor is transmitted and which rotates based on the drive force, the flexible rotating shaft being curved by the force applied by the abutment member, the nipping member is a driven roller that rotates in accordance with a rotation of the discharge roller, the discharge roller comprises a plurality of discharge rollers which are provided on the flexible rotating shaft along an axis direction of the flexible rotating shaft, the abutment member comes in contact with the flexible rotating shaft in an area formed between the plurality of discharge rollers, the abutment member comprises an urging member that urges the flexible rotating shaft in a substantially vertical direction, and the urging member comprises a plurality of urging members provided at intervals along a direction of the flexible rotating shaft, and the plurality of urging members have mutually different urging forces.

12. The image forming apparatus according to claim 11, wherein the abutment member comprises a supporting member that supports the flexible rotating shaft at a vertically different position relative to the first bearing member and the second bearing member.

13. The image forming apparatus according to claim 11, wherein the urging member comprises an elastic member that urges the flexible rotating shaft in a substantially vertical direction.

14. The image forming apparatus according to claim 11, wherein the nipping member comprises:

a roller abutting against a sheet surface; and a holder for rotatably supporting the roller.

15. The image forming apparatus according to claim 11, further comprising a discharge tray on which the sheet discharged by the discharge roller is placed, the discharge tray being provided below the discharge roller, wherein the abutment member is disposed at a position for deflecting the flexible rotating shaft such that a curved convex portion of the discharged sheet projects toward the discharge tray, while both widthwise end portions, in a direction perpendicular to a transporting direction, of the discharged sheet are positioned farther away from the discharge tray than the convex portion.

16. The image forming apparatus according to claim 11, wherein the abutment member comprises a supporting member integrally formed with a cover on which a discharge tray is formed.

17. The image forming apparatus according to claim 11, wherein the abutment member has a recess portion, the flexible rotating shaft is curved by fitting the recess portion on the flexible rotating shaft.

18. The image forming apparatus according to claim 11, wherein the flexible rotating shaft is formed of a resin material.

19. The image forming apparatus according to claim 11, wherein the abutment member comprises a plurality of abutment members that are provided at intervals along a longitudinal direction of the flexible rotating shaft so that the flexible rotating shaft is curved with a plurality of loop portions between the first bearing member and the second bearing member.

* * * * *